US009262974B2

(12) United States Patent
Lee

(10) Patent No.: US 9,262,974 B2
(45) Date of Patent: Feb. 16, 2016

(54) IMAGE DISPLAY DEVICE INCLUDING DRIVING INTEGRATED CIRCUIT FOR DIFFERENT PIXEL ARRANGEMENT STRUCTURES

(71) Applicant: LG Display Co., Ltd., Seoul (KR)

(72) Inventor: Hyun-Jae Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 27 days.

(21) Appl. No.: 13/904,863

(22) Filed: May 29, 2013

(65) Prior Publication Data

US 2014/0160172 A1 Jun. 12, 2014

(30) Foreign Application Priority Data

Dec. 11, 2012 (KR) ..... 10-2012-0143939

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/3685* (2013.01); *G09G 2300/0452* (2013.01); *G09G 2310/027* (2013.01)

(58) Field of Classification Search
CPC . G09G 3/3607; G09G 3/3688; G09G 3/3685; G09G 2300/0452
See application file for complete search history.

(56) References Cited

U.S. PATENT DOCUMENTS

| | | | | |
|---|---|---|---|---|
| 2003/0117362 | A1* | 6/2003 | An | 345/98 |
| 2005/0237280 | A1 | 10/2005 | Oh et al. | |
| 2008/0170027 | A1* | 7/2008 | Kyeong et al. | 345/100 |
| 2008/0278466 | A1 | 11/2008 | Joo | |
| 2009/0153593 | A1* | 6/2009 | Lee et al. | 345/690 |
| 2010/0039453 | A1 | 2/2010 | Chaji et al. | |

FOREIGN PATENT DOCUMENTS

| | | | |
|---|---|---|---|
| CN | 101458911 | A | 6/2009 |
| JP | H11-073164 | A | 3/1999 |
| JP | 2004-045702 | A | 2/2004 |

OTHER PUBLICATIONS

Japan Patent Office, Office Action, Japanese Patent Application No. 2013-254799, Sep. 30, 2014, five pages [with concise explanation of relevance in English].
United Kingdom Intellectual Property Office, Search Report, Patent Application No. GB1320734.5, May 2, 2014, four pages.
Office Action for Chinese Patent Application No. CN 201310251949.4, Jun. 19, 2015, 13 Pages.
Office Action for German Patent Application No. DE 102013113787.3, Sep. 28, 2015, 14 Pages.

* cited by examiner

*Primary Examiner* — John Kirkpatrick
(74) *Attorney, Agent, or Firm* — Fenwick & West LLP

(57) ABSTRACT

A driving integrated circuit capable of driving various image display panels having different pixel arrangements is described. A data driving unit alternately supplies analog image signals to one of two adjacent data lines. A data switching unit selects the data lines such that the image signals are alternately supplied to the adjacent data lines of the plurality of data lines and electrically connecting the data lines to the output channels of the data driving unit.

23 Claims, 7 Drawing Sheets

IMAGE DISPLAY DEVICE INCLUDING DRIVING INTEGRATED CIRCUIT FOR DIFFERENT PIXEL ARRANGEMENT STRUCTURES

CROSS-REFERENCE TO RELATED APPLICATION

This application claims the benefit of Korean Patent Application No. 10-2012-0143939, filed on Dec. 11, 2012, which is hereby incorporated by reference as if fully set forth herein.

BACKGROUND

1. Field of the Disclosure

The disclosure relates to an image display device capable of reducing design and development costs of a driving integrated circuit and manufacturing costs of products by driving various image display panels of different pixel arrangements using one driving integrated circuit, and a method for driving the same.

2. Discussion of the Related Art

Lightweight flat panel displays with slim body have been widely used as image display devices for personal computers, portable tablet terminals, laptops and monitors of various information apparatuses. Such flat panel displays include an Organic Light Emitting Diode (OLED) display device, a Liquid Crystal Display (LCD) device, a plasma display panel, a field emission display, etc.

Each flat panel display includes an image display panel on which a plurality of pixel cells are arranged and a driving integrated circuit for driving the image display panel and displaying an image on the image display panel. For example, in an OLED, pixel circuits for controlling the levels of current supplied to organic light emitting diodes are arranged in the pixel cells and an image is displayed on the image display panel using the driving integrated circuit.

Recent image display panels used for tablet mobile communication apparatuses or various mobile communication apparatuses have various pixel arrangement structures. For example, a PenTile type pixel arrangement structure uses red (R), green (G) and blue (B) pixels repeatedly arranged in order of RGBG or BGRG according to constraints for high-resolution implementation and a pixel arrangement structure in which red (R), green (G) and blue (B) pixels are repeatedly arranged in order of RGB or BGR according to text readability and user requirements.

Conventionally, different driving integrated circuits for driving pixels are used for image display panels having different pixel arrangement structures. Hence, the cost of designing and developing the driving integrated circuits was high. That is, since different driving integrated circuits driving respective display panels are used to an image display panel where the pixels are arranged in the order of RGBG or BGRG and an image display panel where the pixels are arranged in the order of RGB or BGR, development costs and manufacturing costs of the driving integrated circuits were high.

SUMMARY OF THE DISCLOSURE

Embodiments relate to an image display device comprising a display panel, a plurality of data line, a data driving unit and a data switching unit. The display panel includes a plurality of pixel regions for displaying an image. The plurality of data lines includes a first set of data lines and a second set of data lines. Each of the plurality of data lines connected to a corresponding pixel to carry an analog image signal for the corresponding pixel. The data driving unit generates analog image signals for outputting at a plurality of output channels responsive to receiving digital image data representing color values of the plurality of pixels, and routes the analog image signals to the plurality of output channels according to a channel change signal representing color arrangement of pixels in the plurality of pixel regions. The data switching unit is placed between the data driving unit and the plurality of data lines. The data switching unit selects the first set of data lines at first times to transmit the analog image signals to the plurality of pixels.

In one embodiment, the data switching unit selects the second set of data lines at second times.

In one embodiment, each of the first times corresponds to a half of a horizontal period or an odd numbered frame period and each of the second times corresponds to another half of the horizontal period or an even numbered frame period.

In one embodiment, the image display device further includes a timing controller. The timing controller generates the digital image data, the channel change signal and a selection signal. In one embodiment, the first times and the second times are defined by a voltage level of the selection signal.

In one embodiment, the data driving unit includes a plurality of first latches, a plurality of second latches, an RG_digital analog converter, a B_digital analog converter, a plurality of output buffers and a channel switching unit. The plurality of first latches sequentially sample the digital image data and simultaneously output a subset of the digital image data corresponding to a horizontal row of the pixels. The plurality of second latches divide the subset of the digital image data into either a red image data and a green image data or a first blue image data and a second blue image data. The RG_digital analog converter generates a red analog image signal and a green analog image signal by converting red and green image data received from the plurality of second latches using a first gamma voltage set for equally subdividing red and green grayscale levels. The B_digital analog converter generates a first blue analog image signal and a second blue analog image signal by converting the first and second blue image data using a second gamma voltage set for equally subdividing blue grayscale levels. The plurality of output buffers amplify the red image data, the green image data, the first blue image data and the second blue image data. The channel switching unit routes the amplified red image data, the amplified green image data, the amplified first blue image data, and the amplified second blue image data based on the channel change signal.

In one embodiment, the channel switching unit includes a first through seventh switches. The first switch supplies an image signal from a (3i−2)th output buffer to a (3i−2)th output channel in response to the channel change signal (where i is an integer larger than 0). The second switch supplies an image signal from a (3i)th output buffer to a (3i−2)th output channel in response to the channel change signal. The third switch supplies an image signal from a (3i−2)th output buffer to a (3i−1)th output channel in response to the channel change signal. The fourth switch supplies an image signal from a (3i−1)th output buffer to a (3i−1)th output channel in response to the channel change signal. The fifth switch supplies an image signal from a (3i)th output buffer to a (3i−1)th output channel in response to the channel change signal. The sixth switch supplies an image signal from a (3i−1)th output buffer to a (3i)th output channel in response to the channel change signal. The seventh switch supplies an image signal from a (3i)th output buffer to a (3i)th output channel in response to the channel change signal.

In one embodiment, the pixels are repeated in an order of RGB. The first, fourth and seventh switches of the channel switching unit are turned on during the first times, and the first, fifth and sixth switches of the channel switching unit are turned on during the second times. The first times include a half of one horizontal period or an odd numbered frame period. The second times include the other half the horizontal period or an even numbered frame period.

In one embodiment, the pixels are repeated in an order of RGBG, BGRG or a combination of RGRG and BGBG. The first and seventh switches of the channel switching unit are turned on during the first times. The first and sixth switches of the channel switching unit are turned on during the second times. The first times include a half of an odd numbered horizontal period. The second times include the other half of the odd numbered horizontal period.

In one embodiment, the data switching unit includes a plurality of first switching elements and a plurality of second switching elements. The plurality of first switching elements are operated simultaneously to connect (6i−4)th data line to (3i−2)th output channel, (6i−3)th data line to (3i−1)th output channel, and (6i−1)th data line to (3i)th output channel. The plurality of second switching elements are operated simultaneously to connect (6i−5)th data line to (3i−2)th output channel, (6i−2)th data line to (3i−1)th output channel, and (6i)th data line to (3i)th output channel.

In one embodiment, the plurality of first switching elements are operated simultaneously to connect (6i−4)th data line to (3i−2)th output channel, (6i−2)th data line to (3i−1)th output channel and (6i−1)th data line to (3i)th output channel. The plurality of second switching elements are operated simultaneously to connect (6i−5)th data line to (3i−2)th output channel, (6i−3)th data line to (3i−1)th output channel and (6i)th data line to (3i)th output channel.

In one embodiment, the plurality of first switching elements are operated simultaneously to connect (4i−2)th data line to (3i−2)th output channel and (4i)th data line to (3i)th output channel. The plurality of second switching elements are operated simultaneously to connect (4i−3)th data line to (3i−2)th output channel and (4i−1)th data line to (3i)th output channel.

Embodiments also relate to a method of driving an image display device. receiving digital image data representing color values of the plurality of pixels. Analog image signals for outputting at a plurality of output channels of the data driving unit are generated responsive to receiving the digital image data. Each of the analog image signals is routed to each of a plurality of output channels according to a channel change signal representing color arrangement of pixels in the plurality of pixel regions by a data driving unit. A first set of data lines is selected at first times to transmit the analog image signals to a plurality of pixels in a display panel by a data switching unit. A subset of the analog image signals is sent to a subset of the plurality of pixels via the selected set of data lines.

In one embodiment, the second set of data lines is selected at second times.

In one embodiment, the first times and the second times are defined by a voltage level of a selection signal generated by a timing controller.

BRIEF DESCRIPTION OF THE DRAWINGS

The accompanying drawings, which are included to provide a further understanding of embodiments and are incorporated in and constitute a part of this application, illustrate embodiments and together with the description serve to explain the principle of the disclosure. In the drawings.

DETAILED DESCRIPTION OF THE EMBODIMENTS

Hereinafter, an image display device and a method for driving the same according to embodiments will be described in detail with reference to the accompanying drawings. Although embodiments are described herein primarily with reference to an organic light emitting diode (OLED) display device for convenience, embodiments are also applicable to a liquid crystal display device, a field emission display device, a plasma display panel, etc.

Figure 1:
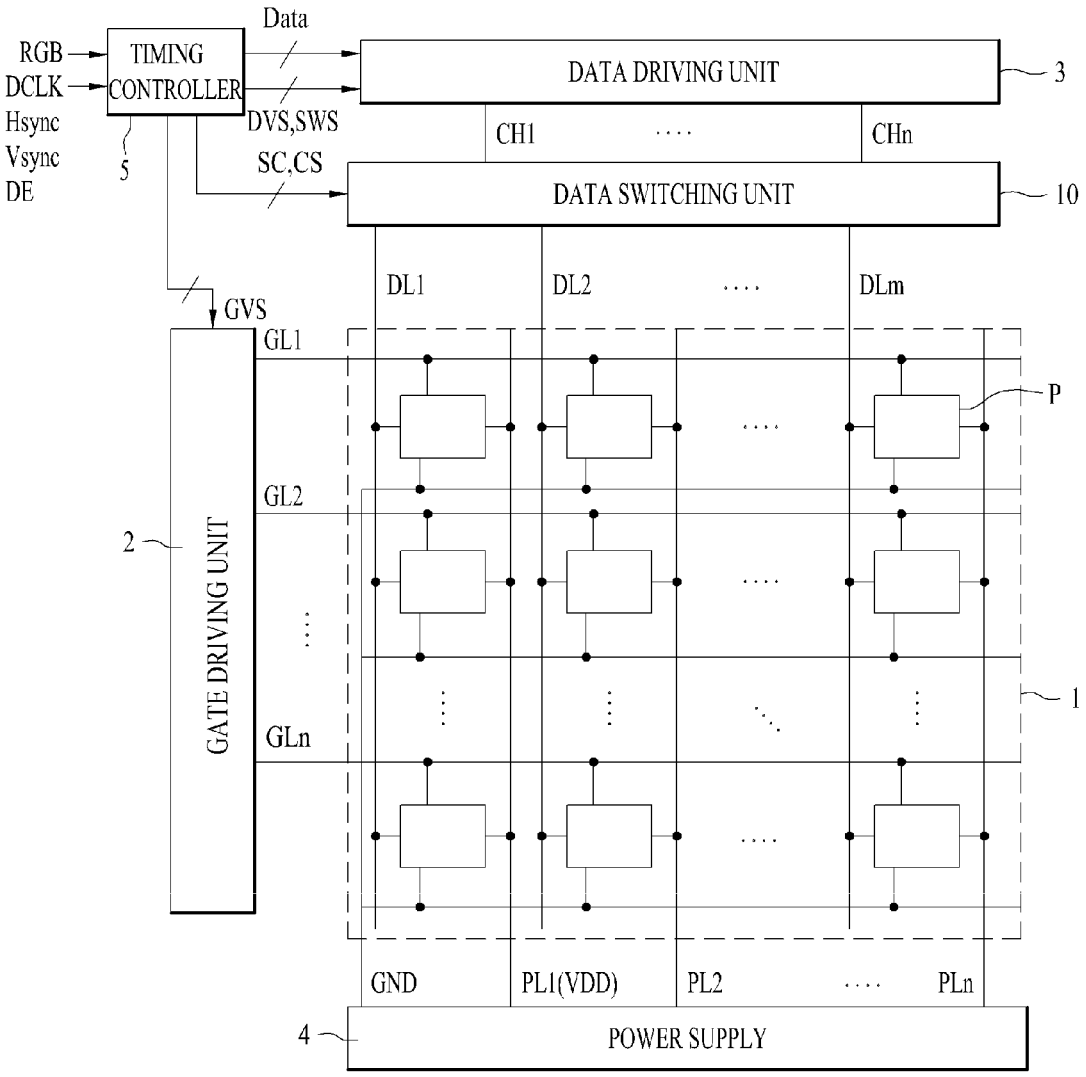
FIG. 1 is a block diagram showing an organic light emitting diode (OLED) display device, according to an embodiment.

FIG. 1 is a block diagram showing an organic light emitting diode (OLED) display device according to one embodiment. The OLED display device shown in FIG. 1 includes a display panel 1 including a plurality of pixel (P) regions to display an image; a gate driving unit 2 for driving gate lines GL1 through GLn of the display panel 1; a data driving unit 3 for generating image signals to be alternately supplied to adjacent data lines among the data lines DL1 through DLm of the display panel 1 and changing and outputting output channels CH1 through CHn of the image signals according to a pixel arrangement structure of the display panel 1; a power supply 4 for supplying first and second power signals VDD and GND to power lines PL1 through PLm of the display panel 1; a data switching unit 10 for alternately selecting data lines such that the image signals are supplied to adjacent data lines among the plurality of data lines DL1 through DLm to be electrically connected to the output channels CH1 through CHn of the data driving unit 3; and a timing controller 5 for aligning and supplying external image data RGB to the data driving unit 3, generating a plurality of selection signals SC and CS, a channel change signal SWS and a gate control signal GVS and controlling operations of the data switching unit 10 and the data and gate driving units 3 and 2.

In the image display panel 1, a plurality of pixels P are arranged in the form of a matrix in respective pixel regions. Red (R), green (G) and blue (B) pixels P are repeated in the order of RGBG or BGRG or in the order of RGB or BGR.

Each of the pixels P repeats in the order of RGBG or BGRG or in the order of RGB or BGR includes a light emitting diode and a diode driving circuit for independently driving the light emitting diode. More specifically, each pixel P includes a diode driving circuit connected to any one gate line GL, data line DL and power line PL and a light emitting diode connected between the diode driving circuit and the second power signal GND.

Each diode driving circuit supplies an analog data signal (i.e., an image signal) from the data line DL to the light emitting diode and maintains a light emitting state.

The gate driving unit 2 sequentially generates gate on signals (e.g., gate voltages of a low logic level) in response to a gate control signal (GVS) from the timing controller 5. For example, a gate start pulse (GSP) and a gate shift clock (GSC) control pulse widths of the gate on signals according to a gate output enable (GOE) signal. The gate on signals are sequentially supplied to gate lines GL1 through GLn. In a period in which the gate on voltages are not supplied to the gate lines GL1 through GLn, gate off voltages (e.g., gate voltages of a high logic level) are supplied.

The data driving unit 3 generates an image signal of a ½ horizontal line during a half of the horizontal period such that adjacent data lines DL1 through DLm are alternately driven in every horizontal period using a data control signal DVS from the timing controller 5. The data control signal DVS includes, for example, a source start pulse (SSP), a source shift clock (SSC) and a source output enable (SOE) signal. More specifically, the data driving unit 3 latches digital image data of a ½ horizontal line according to SSC and selects a gamma voltage having a predetermined level according to a grayscale value of the latched image data such that adjacent data lines DL1 through DLm are alternately driven in one horizontal period, thereby converting the digital image data into the image signal. In response to the SOE signal, the image signals of two pixels are supplied to the output channels CH1 through CHn during one horizontal period in which a scan pulse is supplied to each of the gate lines GL1 through GLn. At this time, the data driving unit 3 changes and outputs the output channels CH1 through CHn of the image signals in response to the channel change signal SWS supplied according to the pixel P arrangement structure of the display panel 1. In other words, the data driving unit 3 supplies the channel change signal SWS generated by the timing controller 5 in ½ horizontal period units so as to correspond to the pixel P arrangement structure of the display panel 1. In response to the channel change signal SWS received in the ½ horizontal period units, the output channels CH1 through CHn of the image signals are changed and output in ½ horizontal period units.

The data switching unit 10 includes a plurality of multiplexer circuits including a plurality of switching elements and alternately connects (3i−2)th or (3i−1)th data lines (where i is an integer larger than 0) to the image signal output channels CH1 through CHn of the data driving unit 3 such that the (3i−2)th data lines and the (3i−1)th data lines are driven in different halves of a horizontal period according to the first and second selection signals SC and CS received from the timing controller 5. In other words, the data switching unit 10 electrically connects the (3i−2)th data lines to the image signal output channels CH1 through CHn corresponding thereto in a ½ horizontal period in response to the first selection signal CS and electrically connects the (3i−1)th data lines to the image signal output channels CH1 through CHn corresponding thereto in the other ½ horizontal period in response to the second selection signal SC.

The timing controller 5 aligns and supplies the external image data to the data driving unit 3 such that adjacent data lines DL1 through DLm are alternately driven in at least one horizontal period to display an image. The timing controller generates a gate control signal GCS and a data control signal DCS using external synchronization signals DCLK, DE, Hsync and Vsync to respectively control the data driving unit 3 and the gate driving unit 2.

In particular, the timing controller 5 generates the channel change signal SWS in half horizontal period units such that the image signals generated by the data driving unit 3 in half horizontal period units are output in correspondence with the pixel P arrangement structure of the display panel 1. The pixels P of the display panel 1 are repeatedly arranged in the order of RGBG or BGRG or in the order of RGB or BGR. The timing controller 5 generates the channel change signal SWS such that the image signals of the data driving unit 3 are output according to the pixel P arrangement of the display panel 1. By supplying the channel change signal SWS to the data driving unit 3, the data driving unit 3 changes and outputs the output channels CH1 through CHn of the image signals according to the pixel P arrangement structure of the display panel 1.

In addition, the timing controller 5 generates the first and second selection signals SC and CS such that the data switching unit 10 alternately selects adjacent data lines DL1 through DLn to be electrically connected to the image signal output channels CH1 through CHn of the data driving unit 3, and controls the data switching unit 10. At this time, the timing controller 5 generates the first and second selection signals SC and CS such that the phases (e.g., logic levels) of the first and second selection signals are alternately changed in half horizontal period units or in image display period units of every frame period and supplies the first and second selection signals SC and CS to the data switching unit 10. For example, in a half horizontal period or in an image display period of an odd numbered frame of every frame period, the first selection signal CS with a low logic level and the second selection signal SC with a high logic level may be generated. In the other half horizontal period or in an image display period of an even numbered frame of every frame period, the first selection signal CS with a high logic level and the second selection signal SC with a low logic level may be generated.

Figure 2:
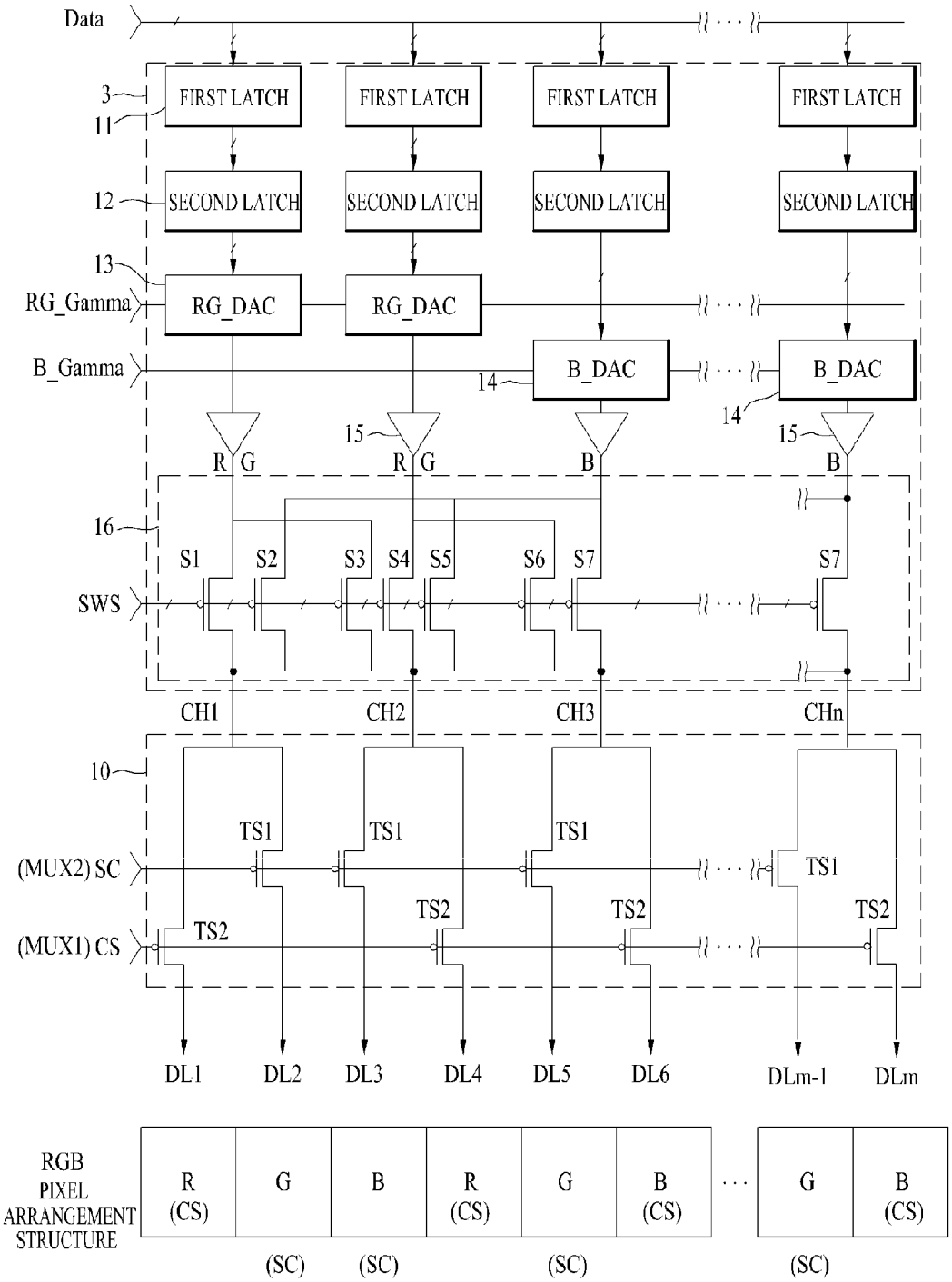
FIG. 2 is a circuit diagram of a data driving unit and a data switching unit of FIG. 1 according to a first embodiment.

FIG. 2 is a circuit diagram a data driving unit and a data switching unit of FIG. 1, according to a first embodiment. The data driving unit 3 shown in FIG. 2 may include a plurality of first latches 11, a plurality of second latches 12, an RG_digital analog converter (DAC) 13, a B_digital analog converter, a plurality of output buffers 15, and a channel switching unit 16. The plurality of first latches 11 sequentially samples image data Data from the timing controller 5, stores image data of one horizontal line, and simultaneously outputs data of the horizontal line.

The plurality of second latches 12 divides and stores data of adjacent pixels of the data of one line received from the plurality of first latches 11 in ½ horizontal period units and sequentially supplies the image data stored in the ½ horizontal period units to the RG_DAC 13 or the B_DAC 14.

An RG_digital analog converter (DAC) 13 converts red and green image data received from the plurality of second latches 12 into analog image signals using a first gamma voltage set RG_Gamma for subdividing grayscale levels of red (R) and green (G). That is, the red and green image data is converted into red green image signals using one RG_DAC 13 for output. The RG_DAC 13 converts the red and green image data in ½ horizontal period units and outputs the converted signals.

The B_digital analog converter (DAC) 14 converts blue image data received from the plurality of second latches 12 using a second gamma voltage set B_Gamma for subdividing grayscale levels of blue (B) into analog image signals and outputs the analog image signals. The blue image data is converted into analog image signals using the second gamma voltage set B_Gamma for subdividing the grayscale levels of blue so as to be output.

The plurality of output buffers 15 amplify and output the image signals received from the RG_DAC 13 and the B_DAC 14.

The channel switching unit 16 for changes and outputs output channels CH1 through CHn of the image signals received from the output buffers 15 in response to changes in the channel change switch SWS and output according to the pixel P arrangement structure of the display panel 1. The channel switching unit 16 includes a first switch S1 for supplying the image signal from a (3i−2)th output buffer 15 to a (3i−2)th output channel in response to the channel change signal SWS, a second switch S2 for supplying the image signal from a (3i)th output buffer 15 to the (3i−2)th output channel in response to the channel change signal SWS, a third switch S3 for supplying the image signal from a (3i−2)th output buffer 15 to a (3i−1)th output channel in response to the channel change signal SWS, a fourth switch S4 for supplying the image signal from a (3i−1)th output buffer 15 to the (3i−1)th output channel in response to the channel change signal SWS, a fifth switch S5 for supplying the image signal from a (3i)th output buffer 15 to the (3i−1)th output channel in response to the channel change signal SWS, a sixth switch S6 for supplying the image signal from a (3i−1)th output buffer 15 to the (3i)th output channel in response to the channel change signal SWS, and a seventh switch S7 for supplying the image signal from a (3i)th output buffer 15 to the (3i)th output channel in response to the channel change signal SWS.

Each of the first to seventh switches S1 through S7 receives one of the plurality of channel change signals SWS. Each of the first to seventh switches is turned on or off according to the logic level (e.g., a low voltage level or high voltage level) of the received channel change signal SWS. For example, each of the first to seventh switches S1 to S7 is made of a NMOS or PMOS transistor. Each of the first to seventh switches S1 through S7 is turned on or off according to the logical level of the channel change switch SWS received in half horizontal period units to change and output the output channels CH1 through CHn of the image signal received from each output buffer 15.

The data switching unit 10 of FIG. 2 includes a plurality of first switching elements TS1 which is provided between (6i−4)th, (6i−3)th and (6i−1)th data lines, and corresponding (3i−2)th, (3i−1)th and 3ith image signal output channels so as to electrically connect the (6i−4)th, (6i−3)th and (6i−1)th data lines to corresponding (3i−2)th, (3i−1)th and (3i)th image signal output channels according to the second selection signal SC and a plurality of second switching elements TS2 which is provided between (6i−5)th, (6i−2)th and (6i)th data lines and corresponding (3i−2)th, (3i−1)th and (3i)th image signal output channels so as to electrically connect (6i−5)th, (6i−2)th and 6ith data lines to corresponding (3i−2)th, (3i−1)th and (3i)th image signal output channels according to the first selection signal CS.

Although the plurality of first switching elements TS1 and the plurality of second switching elements TS2 are made of an NMOS transistor or a PMOS transistor, the embodiments are described herein using PMOS transistors as the plurality of first and second switching elements TS1 and TS2. In this case, each of the plurality of first switching elements TS1 is turned on only during a period in which a second selection signal SC of a low logic level is supplied, so as to electrically connect the (6i−4)th, (6i−3)th and (6i−1)th data lines to corresponding (3i−2)th, (3i−1)th and (3i)th image signal output channels. Each of the plurality of second switching elements TS2 is turned on only during a period in which a second selection signal SC of a low logic level is supplied, so as to electrically connect the (6i−5)th, (6i−2)th and (6i)th data lines to corresponding (3i−2)th, (3i−1)th and (3i)th image signal output channels.

In the case in which the pixels of the display panel 1 are repeatedly arranged in order of RGB, red pixel columns display a red image in the same half horizontal period or frame period and display the image in the half horizontal period or frame period different from that of green pixel columns, and the green pixel columns display a green image in the same half horizontal period or frame period and display the image in the half horizontal period or frame period different from that of red pixel columns. In this case, unlike the case in which the data lines are alternately driven in units of odd or even numbered lines, the voltage level of the red and green image signal alternately selected and supplied to each data line DL is not distorted, thereby preventing display image quality deterioration. Blue pixel columns may be alternately driven in the same frame period as the red or green pixel columns. Since human visual perception is weak in the blue band, even when light intensity of blue is slightly distorted, image quality is not adversely affected by distortion.

Figure 3:
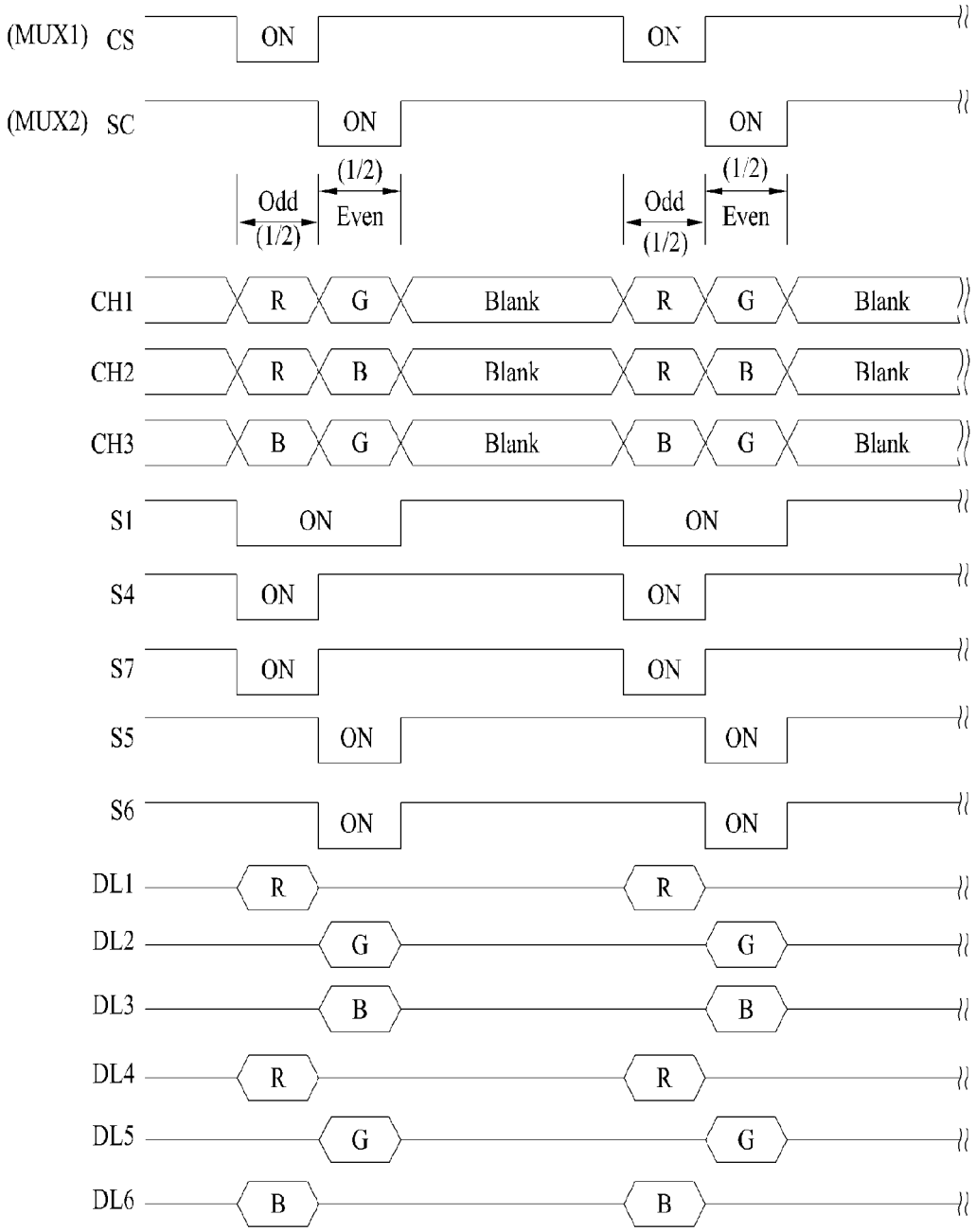
FIG. 3 is a timing chart illustrating timing of signals for driving the data driving unit and data switching unit of FIG. 2.

FIG. 3 is a timing chart illustrating timing of signals for driving the data driving unit and data switching unit of FIG. 2. Referring to FIG. 3, if the pixels of the display panel 1 are repeatedly arranged in the order of RGB, the timing controller 5 generates and outputs the channel change signal SWS such that the first, fourth and seventh switches S1, S4 and S7 of the channel switching unit 16 are turned on during a half of a horizontal period or an odd numbered frame period and outputs the channel change signal SWS such that the first, fifth and sixth switches S1, S5 and S6 of the channel switching unit 16 are turned on during the other half of the horizontal period or an even numbered frame period (see Table 1). In this case, the first switch S1 of the channel switching unit 16 supplies the image signal from the (3i−2)th output buffer 15 to the (3i−2)th output channel, the fourth switch S4 supplies the image signal from the (3i−2)th output buffer 15 to the (3i−1)th output channel, and the seventh switch S7 supplies the image signal from the (3i)th output buffer 15 to the (3i)th output channel during the half period or the odd numbered frame period in which the channel change signal SWS of an on level is supplied. The first switch S1 of the channel switching unit 16 supplies the image signal from the (3i−2)th output buffer 15 to the (3i−2)th output channel, the fifth switch S5 supplies the image signal from the (3i)th output buffer 15 to the (3i−1)th output channel, and the sixth switch S6 supplies the image signal from the (3i−2)th output buffer 15 to the (3i)th output channel during the half period or the even numbered frame period in which the channel change signal SWS of on level is supplied. Such a control operation is repeated even in a next horizontal period or odd or even numbered frame period.

TABLE 1

| Panel Mode | Panel MUX Operation | SW1 | SW2 | SW3 | SW4 | SW5 | SW6 | SW7 |
|---|---|---|---|---|---|---|---|---|
| Real_RGB | MUX1 ON | ON | OFF | OFF | ON | OFF | OFF | ON |
| | MUX2 ON | ON | OFF | OFF | OFF | ON | ON | OFF |

TABLE 1-continued

| Panel Mode | | Panel MUX Operation | SW1 | SW2 | SW3 | SW4 | SW5 | SW6 | SW7 |
|---|---|---|---|---|---|---|---|---|---|
| Real_BGR | | MUX1 ON | OFF | ON | ON | OFF | OFF | ON | OFF |
| | | MUX2 ON | ON | OFF | OFF | OFF | ON | ON | OFF |
| Pentile | Odd | MUX1 ON | ON | OFF | OFF | OFF | OFF | OFF | ON |
| (RGBG) | Line | MUX2 ON | ON | OFF | OFF | OFF | OFF | ON | OFF |
| (BGRG) | Even | MUX1 ON | OFF | ON | OFF | OFF | OFF | ON | OFF |
| | Line | MUX2 ON | ON | OFF | OFF | OFF | OFF | ON | OFF |

If the pixels of the display panel 1 are repeated in the order of RGB, the timing controller 5 generates the first selection signal CS at an on level and generates the second selection signal SC at an off level during a half of the horizontal period or the odd numbered frame period. The timing controller 5 generates the first selection signal CS at an off level and generates the second selection signal SC at an on level during the other half of the horizontal period or the even numbered frame period. In a blank period of every frame period during which an image is not displayed, the same off logic level may be generated. In this case, each of the plurality of second switching elements TS2 is turned on only during the period in which the first selection signal CS of the on level is supplied so as to electrically connect (6i−5)th, (6i−2)th and 6ith data lines to corresponding (3i−2)th, (3i−1)th and (3i)th image signal output channels CH1, CH2 and CH3. Each of the plurality of first switching elements TS1 is turned on only during the period, in which the second selection signal SC of an on level is supplied, so as to electrically connect (6i−4)th, (6i−3)th and (6i−1)th data lines to corresponding (3i−2)th, (3i−1)th and 3i-th image signal output channels CH1, CH2 and CH3. Such a control operation is repeated even during a next horizontal period or odd or even numbered frame period.

As described above, the data driving unit 3 and the data switching unit 10 drive the (3i−2)th data lines included in the red (R) pixel column and the (3i−1)-th data lines included in the green (G) pixel column in different frame periods in response to the channel change signals SWS having a phase difference at different logic levels and the first and second selection signals SC and CS, thereby preventing a coupling phenomenon of the red and green pixels.

In particular, one embodiment of data driving unit 3 is applicable to the display panel 1 with pixels repeatedly arranged in the order of RGB and the data lines of the display panel 1 are selectively driven to simplify a driver circuit of the display panel 1. Therefore, deterioration of display image quality of the image display panel is prevented while manufacturing costs of the image display device are reduced and improving reliability of the image display device.

Figure 4:
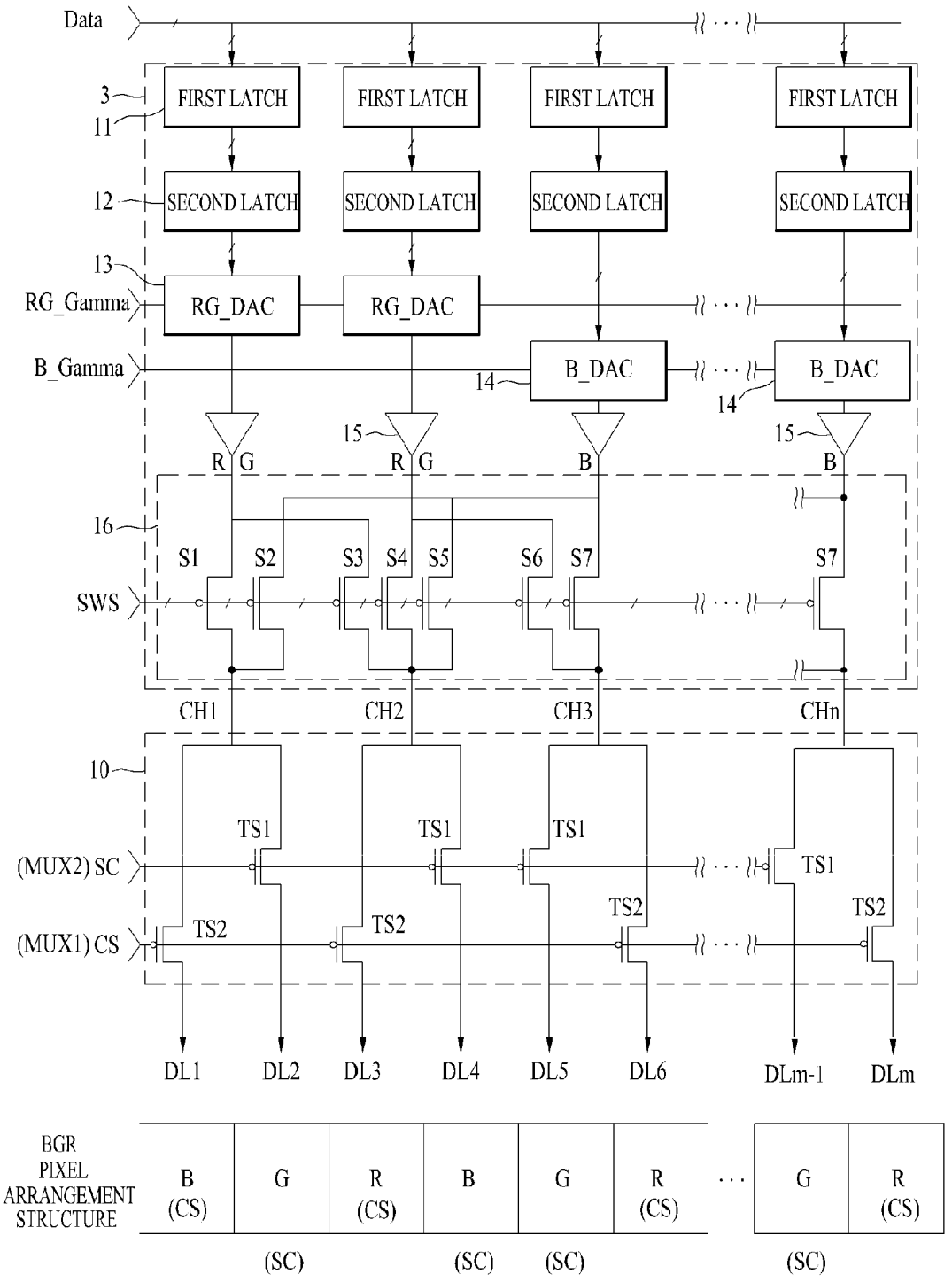
FIG. 4 is a circuit diagram of a data driving unit and a data switching unit of FIG. 1, according to a second embodiment.

FIG. 4 is a circuit diagram of a data driving unit and a data switching unit shown in FIG. 1 according to a second embodiment. The structure of the data driving unit 3 shown in FIG. 4 is equivalent to that of the data driving unit 3 shown in FIG. 2, and therefore, detailed explanation thereof is omitted herein.

The data switching unit 10 of the FIG. 4 includes a plurality of first switching elements TS1 provided between (6i−4)th, (6i−2)th and (6i−1)th data lines and corresponding (3i−2)th, (3i−1)th and (3i)th image signal output channels so as to electrically connect the (6i−4)th, (6i−2)th and (6i−1)th data lines to the corresponding (3i−2)th, (3i−1)th and (3i)th image signal output channels according to the second selection signal SC and a plurality of second switching elements TS2 provided between (6i−5)th, (6i−3)th and (6i)th data lines and corresponding (3i−2)th, (3i−1)th and (3i)th image signal output channels so as to electrically connect the (6i−5)th, (6i−3)th and (6i)th data lines to the corresponding (3i−2)th, (3i−1)th and (3i)th image signal output channels according to the first selection signal CS.

Each of the plurality of first switching elements TS1 is turned on only during a period during which a second selection signal SC of an on level is supplied so as to electrically connect the (6i−4)th, (6i−2)th and (6i−1)th data lines to the corresponding (3i−2)th, (3i−1)th and (3i)th image signal output channels. Each of the plurality of second switching elements TS2 is turned on only during a period, during which a first selection signal CS of an on level is supplied so as to electrically connect the (6i−5)th, (6i−3)th and (6i)th data lines to the corresponding (3i−2)th, (3i−1)th and (3i)th image signal output channels.

Figure 5:
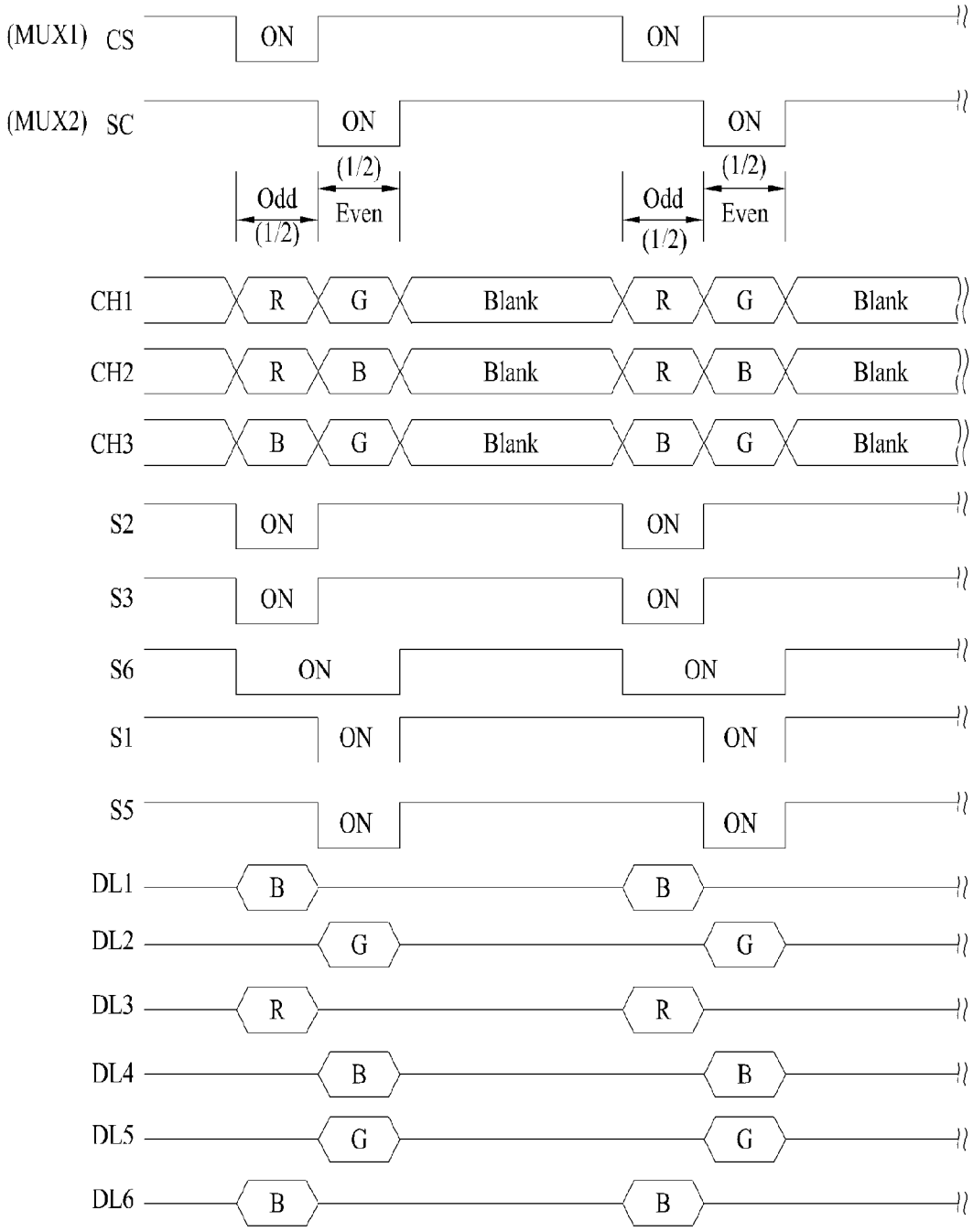
FIG. 5 is a timing chart illustrating timing of signals for driving the data driving unit and data switching unit of FIG. 4.

FIG. 5 is a timing chart illustrating the timing of signals for driving the data driving unit and data switching unit shown in FIG. 4. Referring to FIG. 5, if the pixels of the display panel 1 are repeatedly arranged in the order of BGR, the timing controller 5 generates and outputs the channel change signal SWS such that the second, third and sixth switches S2, S3 and S6 of the channel switching unit 16 are turned on during a half of the horizontal period or an odd numbered frame period and outputs the channel change signal SWS such that the first, fifth and sixth switches S1, S5 and S6 of the channel switching unit 16 are turned on during the other half of the horizontal period or an even numbered frame period (see Table 1). In this case, the second switch S2 of the channel switching unit 16 supplies the image signal from the (3i)th output buffer 15 to the (3i−2)th output channel, the third switch S3 supplies the image signal from the (3i−2)th output buffer 15 to the (3i−1)th output channel, and the sixth switch S6 supplies the image signal from the (3i−1)th output buffer 15 to the (3i)th output channel during the half period or an odd numbered frame period during which the channel change signal SWS of an on level is supplied. The first switch S1 of the channel switching unit 16 supplies the image signal from the (3i−2)th output buffer 15 to the (3i−2)th output channel, the fifth switch S5 supplies the image signal from the (3i)th output buffer 15 to the (3i−1)th output channel, and the sixth switch S6 supplies the image signal from the (3i−2)th output buffer 15 to the (3i)th output channel in the other half period or an even numbered frame period in which the channel change signal SWS of an on level is supplied. Such a control operation is repeated even in a next horizontal period or odd or even numbered frame period.

If the pixels of the display panel 1 are repeatedly in the order of BGR, the timing controller 5 generates the first selection signal CS at an on level and generates the second selection signal SC at an off level during a half of one horizontal period or the odd numbered frame period. The timing controller 5 generates the first selection signal CS at an off level and generates the second selection signal SC at an on level during the other half period of one horizontal period or the even numbered frame period. In a blank period of every frame period during which an image is not displayed, the same off logic level may be generated. In this case, each of the plurality of second switching elements TS2 is turned on only during the period during which the first selection signal CS of an on level is supplied so as to electrically connect (6i−5)th, (6i−3)th and (6i)th data lines to corresponding (3i−2)th, (3i−1)th and (3i)th image signal output channels CH1, CH2 and CH3. Each of the plurality of first switching elements TS1 is turned on only during the period in which the second selection signal SC of an on level is supplied so as to electrically connect (6i−4)th, (6i−2)th and (6i−1)th data lines to corresponding (3i−2)th, (3i−1)th and (3i)th image signal output channels CH1, CH2 and CH3. Such a control operation is repeated even in a next horizontal period or odd or even numbered frame period.

As described above, one type of data driving unit 3 is applicable to the display panel 1 with the pixels repeating in the order of RGB and the data lines of the display panel 1 may be selectively driven to simplify a driver circuit of the display panel 1.

Figure 6:
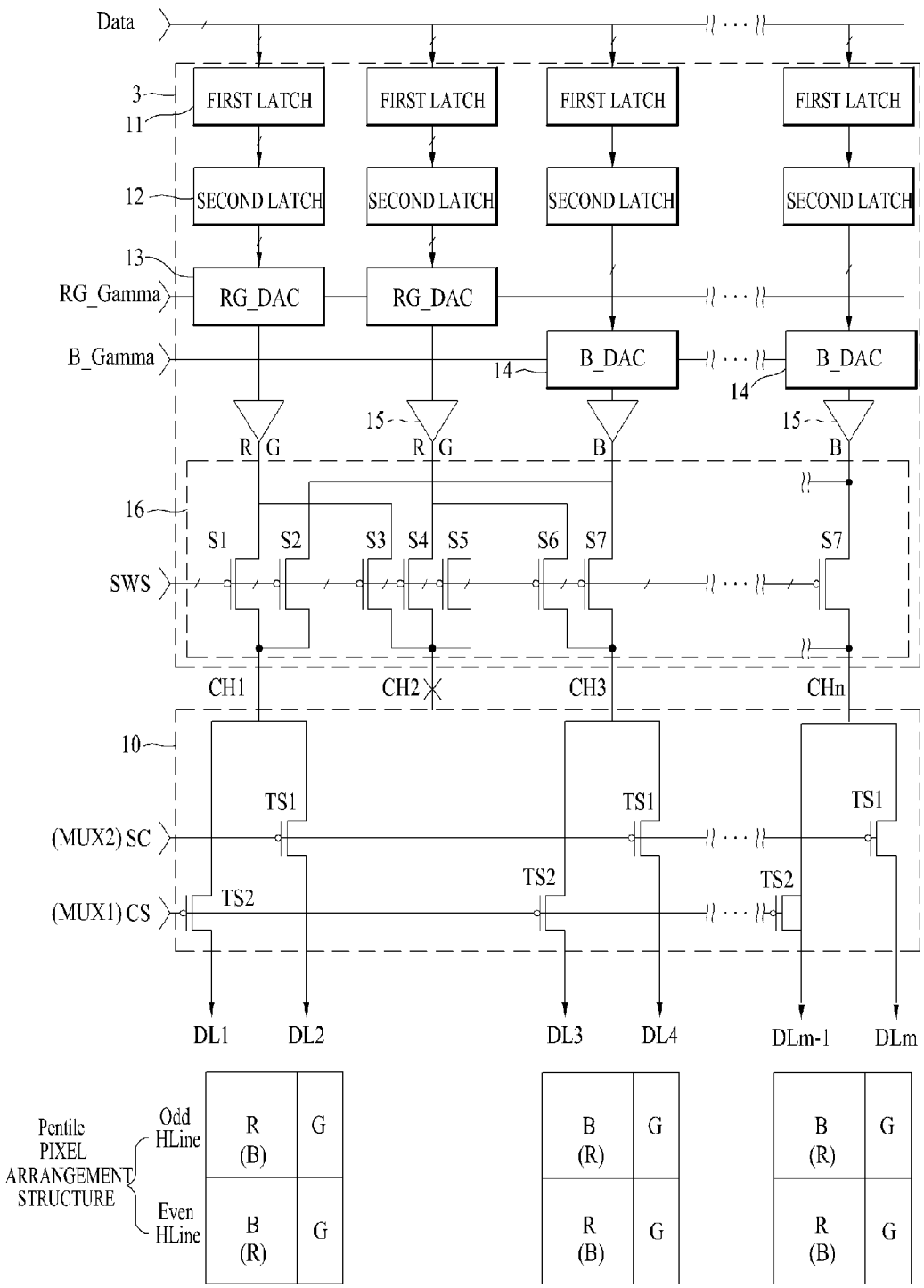
FIG. 6 is a circuit diagram of a data driving unit and a data switching unit shown of FIG. 1 according to a third embodiment.

FIG. 6 is a circuit diagram of a data driving unit and a data switching unit shown in FIG. 1, according to a third embodiment. The structure of the data driving unit 3 shown in FIG. 6 is equivalent to that of the data driving unit 3 shown in FIG. 2, and therefore, details of the data driving unit 3 is omitted herein for the sake of brevity.

The data switching unit 10 of FIG. 6 includes a plurality of first switching elements TS1 provided between (4i−2)th and (4i)th data lines and corresponding (3i−2)th and (3i)th image signal output channels so as to electrically connect the corresponding (4i−2)th and (4i)th data lines to the corresponding (3i−2)th and (3i)th image signal output channels according to the second selection signal SC, and a plurality of second switching elements TS2 provided between (4i−3)th and (4i−1)th data lines and corresponding (3i−2)th and (3i)th image signal output channels so as to electrically connect the (4i−3)th and (4i−1)th data lines to the corresponding (3i−2)th and (3i)th image signal output channels according to the first selection signal CS.

Each of the plurality of first switching elements TS1 is turned on only during a period during which a second selection signal SC of an on level is supplied so as to electrically connect the (4i−2)th and (4i)th data lines to the corresponding (3i−2)th and (3i)th image signal output channels. Each of the plurality of second switching elements TS2 is turned on only during a period during which a first selection signal CS of an on level is supplied so as to electrically connect the (4i−3)th and (4i)th data lines to the corresponding (3i−2)th and (3i)th image signal output channels.

Figure 7:
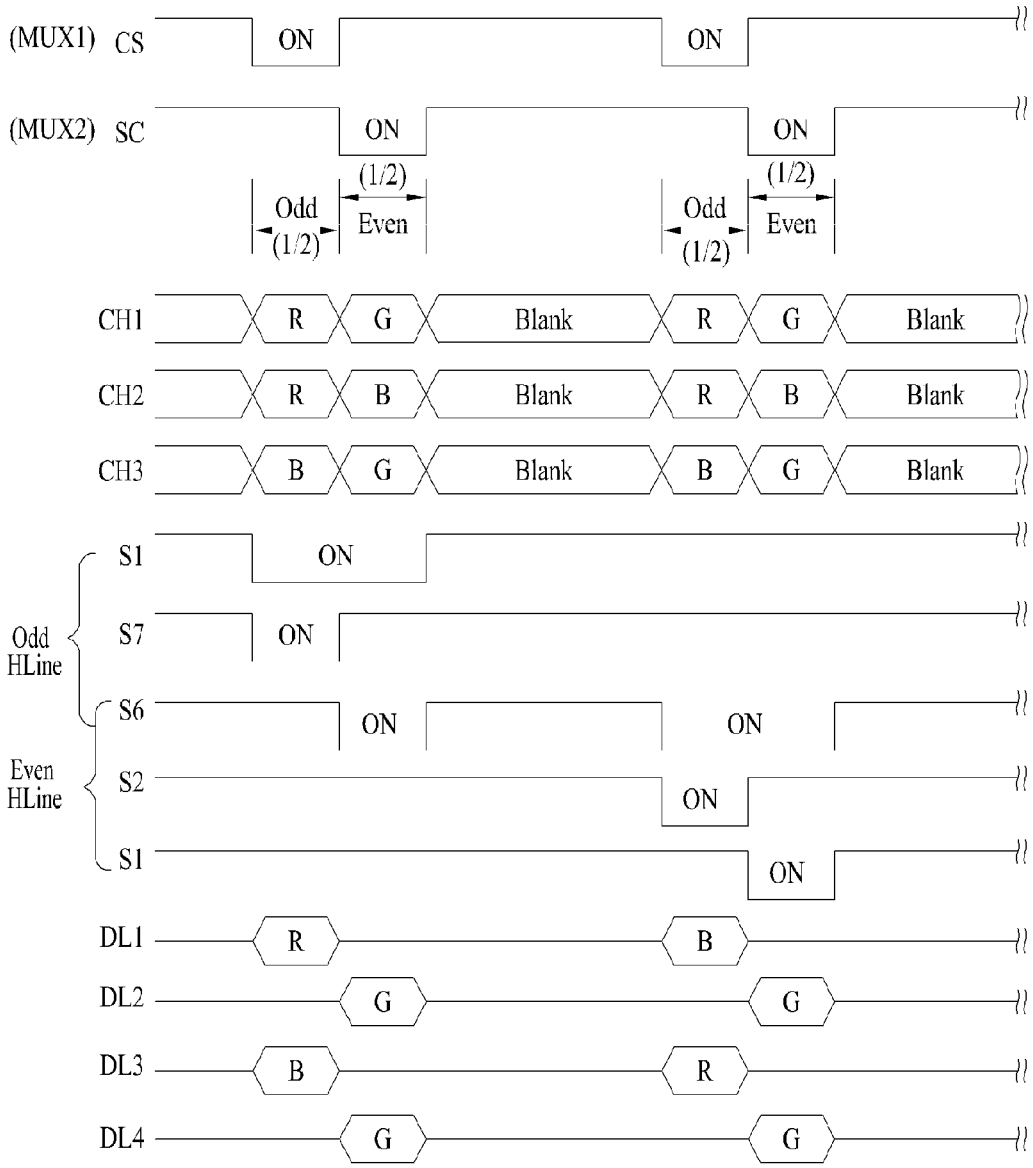
FIG. 7 is a timing chart illustrating timing of signals for driving the data driving unit and data switching unit shown in FIG. 6.

FIG. 7 is a timing chart illustrating the timing of signals for driving the data driving unit and data switching unit shown in FIG. 6, according to one embodiment. Referring to FIG. 7, if the pixels of the display panel 1 are repeated in the order of RGBG, BGRG or a combination of RGRG and BGBG, the timing controller 5 generates and outputs the channel change signal SWS such that the first and seventh switches S1 and S7 of the channel switching unit 16 are turned on during a half period of an odd numbered horizontal period and outputs the channel change signal SWS such that the first and sixth switches S1 and S6 of the channel switching unit 16 are turned on during the other half period of the odd numbered horizontal period (see Table 1). The timing controller 5 generates and outputs the channel change signal SWS such that the second and sixth switches S2 and S6 of the channel switching unit 16 are turned on during a half period of an even numbered horizontal period and outputs the channel change signal SWS such that the first and sixth switches S1 and S6 of the channel switching unit 16 are turned on during the other half period of the even numbered horizontal period.

In this case, the first switch S1 of the channel switching unit 16 supplies the image signal from the (3i−2)th output buffer 15 to the (3i−2)th output channel and the seventh switch S7 supplies the image signal from the (3i)th output buffer to the (3i)th output channel during a half of an odd numbered horizontal period or an odd numbered frame period during which the channel change signal SWS of an on level is supplied. The first switch S1 of the channel switching unit 16 supplies the image signal from the (3i−2)th output buffer 15 to the (3i−2)th output channel and the sixth switch S6 supplies the image signal from the (3i−1)th output buffer to the (3i)th output channel during the other half of the odd numbered horizontal period in which the channel change signal SWS of an on level is supplied.

Thereafter, the second switch S2 of the channel switching unit 16 supplies the image signal from the 3i-th output buffer 15 to the (3i−2)th output channel and the sixth switch S6 supplies the image signal from the (3i−1)th output buffer 15 to the (3i)th output channel during a half of an even numbered horizontal period during which the channel change signal SWS of an on level is supplied. The first switch S1 of the channel switching unit 16 supplies the image signal from the (3i−2)th output buffer 15 to the (3i−2)th output channel and the sixth switch S6 supplies the image signal from the (3i−1) th output buffer 15 to the (3i)th output channel in the other half of the even numbered horizontal period during which the channel change signal SWS of an on level is supplied. Such a control operation is repeated even in a next horizontal period or odd or even numbered frame period.

If the pixels of the display panel 1 are repeated in the order of RGBG, BGRG or a combination of RGRG and BGBG, the timing controller 5 generates the first selection signal CS at an on level and generates the second selection signal SC at an off level during a half of one horizontal period or the odd numbered frame period. The timing controller 5 generates the first selection signal CS at an off level and generates the second selection signal SC at an on level in the other half of one horizontal period or the even numbered frame period. In a blank period of every frame period during which an image is not displayed, the same off logic level may be generated. In this case, each of the plurality of second switching elements TS2 is turned on only during the period during which the first selection signal CS of an on level is supplied so as to electrically connect (4i−3)th and (4i−1)th data lines to corresponding (3i−2)th and (3i)th image signal output channels CH1 and CH3. Each of the plurality of first switching elements TS1 is turned on only during the period during which the second selection signal SC of an on level is supplied so as to electrically connect (4i−2)th and (4i)th data lines to corresponding (3i−2)th and (3i)th image signal output channels CH1 and CH3. Such a control operation is repeated even in a next horizontal period or odd or even numbered frame period.

As described above, the data driving unit 3 applied to the first and second embodiments is applicable to the display panel 1 with the pixels repeating in the order of RGBG, BGRG or a combination of RGRG and BGBG, and the data lines of the display panel 1 may be selectively driven to simplify a driver circuit of the display panel 1.

As described above, the data driving unit 3 and the data switching unit 10 drive the (3i−2)th data lines included in the red (R) pixel column and the (3i−1)th data lines included in the green (G) pixel column during different frame periods in response to the channel change signals SWS having a phase difference at different logic levels and the first and second selection signals SC and CS, thereby preventing a coupling phenomenon of the red and green pixels.

In particular, one type of data driving unit 3 is applicable to the display panel 1 on which the pixels are repeatedly arranged in order of RGB and the data lines of the display panel 1 may be selectively driven to simplify a driver circuit of the display panel 1. Therefore, the deterioration of display image quality of the image display panel is prevented while manufacturing costs of the image display device are reduced and the reliability is improved.

According to an image display device and a method for driving the same of the embodiment, the design and development costs of a driving integrated circuit and manufacturing costs of products may be reduced by driving various image display panels having different pixel arrangement structures using one driving integrated circuit. Further, by preventing distortion of the image signals by alternately and selectively supplying the image signal to the data lines of the image display panel in an alternating and selective manner, embodiments prevent deterioration of display image quality deterioration and improve reliability of the image display device.

It will be apparent to those skilled in the art that various modifications and variations can be made. Thus, it is intended that the present disclosure covers the modifications and variations of the embodiments provided they come within the scope of the appended claims and their equivalents.

What is claimed is:

1. An image display device comprising:

a first display panel including a plurality of pixel regions of a first predetermined color arrangement of pixels for displaying an image;

a plurality of data lines comprising a first set of data lines and a second set of data lines, each of the plurality of data lines connected to a corresponding pixel to carry an analog image signal for the corresponding pixel;

a data driving unit configured to support a plurality of color arrangements of pixels of a plurality of display panels, the data driving unit further configured to generate analog image signals and route each of the analog image signals to each of a plurality of output channels according to a channel change signal that differs when the data driving unit supports a second display panel with a second predetermined color arrangement of pixels, the second predetermined color arrangement being one of the plurality of color arrangements of the pixels of the plurality of display panels responsive to receiving digital image data representing color values of the plurality of pixels; and a data switching unit between the plurality of output channels of the data driving unit and the plurality of data lines, the data switching unit configured to select the first set of data lines at first times to transmit a subset of the analog image signals to the plurality of pixels, wherein the channel change signal differs according to the second predetermined color arrangement of the pixels of the second display panel.

2. The image display device of claim 1, wherein the data switching unit is configured to select the second set of data lines to transmit another subset of the analog signals to the plurality of pixels at second times.

3. The image display device of claim 2, wherein each of the first times corresponds to a half of a horizontal period or an odd numbered frame period and each of the second times corresponds to another half of the horizontal period or an even numbered frame period.

4. The image display device of claim 2, further comprising a timing controller configured to generate the digital image data, the channel change signal and a selection signal, a voltage level of the selection signal defining the first times and the second times.

5. The image display device according to claim 2, wherein the data driving unit comprises:

a plurality of first latches configured to sequentially sample the digital image data and simultaneously output a subset of the digital image data corresponding to a horizontal row of the pixels;

a plurality of second latches configured to divide the subset of the digital image data into either a red image data and a green image data or a first blue image data and a second blue image data;

an RG_digital analog converter configured to generate a red analog image signal and a green analog image signal by converting red and green image data received from the plurality of second latches using a first gamma voltage set for equally subdividing red and green grayscale levels;

a B_digital analog converter configured to generate a first blue analog image signal and a second blue analog image signal by converting the first and second blue image data using a second gamma voltage set for equally subdividing blue grayscale levels;

a plurality of output buffers configured to amplify the red analog image data, the green analog image data, the first blue analog image data and the second blue analog image data; and a channel switching unit configured to route the amplified red analog image data, the amplified green analog image data, the amplified first blue analog image data, and the amplified second analog blue image data based on the channel change signal.

6. The image display device according to claim 5, wherein the data driving unit comprising:

a first switch configured to supply an image signal from a (3i−2)th output buffer to a (3i−2)th output channel in response to the channel change signal (where i is an integer larger than 0);

a second switch configured to supply an image signal from a (3i)th output buffer to a (3i−2)th output channel in response to the channel change signal;

a third switch configured to supply an image signal from a (3i−2)th output buffer to a (3i−1)th output channel in response to the channel change signal;

a fourth switch configured to supply an image signal from a (3i−1)th output buffer to a (3i−1)th output channel in response to the channel change signal;

a fifth switch configured to supply an image signal from a (3i)th output buffer to a (3i−1)th output channel in response to the channel change signal;

a sixth switch configured to supply an image signal from a (3i−1)th output buffer to a (3i)th output channel in response to the channel change signal; and a seventh switch configured to supply an image signal from a (3i)th output buffer to a (3i)th output channel in response to the channel change signal.

7. The image display device according to claim 6, wherein the pixels are repeated in an order of RGB, and wherein the first, fourth and seventh switches of the channel switching unit are turned on during the first times, and the first, fifth and sixth switches of the channel switching unit are turned on during the second times, the first times comprising a half of one horizontal period or an odd numbered frame period, the second times comprising the other half the horizontal period or an even numbered frame period.

8. The image display device according to claim 6, wherein the pixels are repeated in an order of RGBG, BGRG or a combination of RGRG and BGBG, and wherein the first and seventh switches of the channel switching unit are turned on during the first times, and the first and sixth switches of the channel switching unit are turned on during the second times.

9. The image display device according to claim 2, further comprising:

a plurality of first switching elements operated at the first times to connect the first set of data lines to corresponding output channels, the first set of data lines comprising (6i−5)th data line, (6i−2)th data line, and (6i)th data line, the (6i−5)th data line connected to (3i−2)th output channel, the (6i−2)th data line connected to (3i−1)th output channel, and the (6i)th data line connected to (3i)th output channel (where i is an integer larger than 0);

a plurality of second switching elements operated at the second times to connect the second set of data lines to corresponding output channels, the second set of data lines comprising (6i−4)th data line, (6i−3)th data line, and (6i−1)th data line, the (6i−4)th data line connected to (3i−2)th output channel, (6i−3)th data line connected to (3i−1)th output channel, and (6i−1)th data line connected to (3i)th output channel.

10. The image display device according to claim 2, further comprising:

a plurality of first switching elements operated at the first times to connect the first set of data lines to corresponding output channels, the first set of data lines comprising (6i−5)th data line, (6i−3)th data line and (6i)th data line, the (6i−5)th data line connected to (3i−2)th output channel, the (6i−3)th data line connected to (3i−1)th output channel and the (6i)th data line connected to (3i)th output channel (where i is an integer larger than 0); and a plurality of second switching elements operated at the second times to connect the second set of data lines to corresponding output channels, the second set of data lines comprising (6i−4)th data line to (3i−2)th output channel, (6i−2)th data line to (3i−1)th output channel and (6i−1)th data line to (3i)th output channel (6i−4)th data line to (3i−2)th output channel, (6i−2)th data line to (3i−1)th output channel and (6i−1)th data line to (3i)th output channel.

11. The image display device according to claim 2, further comprising:

a plurality of first switching elements operated at the first times to connect the first set of data lines to corresponding output channels, the first set of data lines comprising (4i−3)th data line and (4i−1)th data line, (4i−3)th data line connected to (3i−2)th output channel and (4i−1)th data line connected to (3i)th output channel (where i is an integer larger than 0); and a plurality of second switching elements operated at the second times to connect the second set of data lines to corresponding output channels, the second set of data lines comprising (4i−2)th data line and (4i)th data line, the (4i−2)th data line connected to (3i−2)th output channel and the (4i)th data line connected to (3i)th output channel.

12. A method for driving an image display device, the method comprising:

receiving digital image data representing color values of a plurality of pixels for a first display panel including a plurality of pixel regions of a first predetermined color arrangement of pixels for displaying an image;

generating analog image signals for outputting at a plurality of output channels of a data driving unit responsive to receiving the digital image data, the data driving unit being configured to support a plurality of color arrangements of pixels of a plurality of display panels;

routing each of the analog image signals to each of a plurality of output channels according to a channel change signal that differs when the data driving unit supports a second display panel with a second predetermined color arrangement of pixels that is one of the plurality of color arrangements of the pixels of the plurality of display panels by the data driving unit;

selecting a first set of data lines at first times to transmit the analog image signals to a plurality of pixels in the first display panel by a data switching unit; and sending a subset of the analog image signals to a subset of the plurality of pixels via the selected set of data lines, wherein the channel change signal differs according to the second predetermined color arrangement of the pixels of the second display panel.

13. The method according to claim 12, further comprising selecting the second set of data lines at second times.

14. The method according to claim 13, wherein each of the first times corresponds to a half of a horizontal period or an odd numbered frame period and each of the second times corresponds to another half of the horizontal period or an even numbered frame period.

15. The method according to claim 12, wherein generating the analog image signals comprises:

sequentially sampling the digital image data and simultaneously outputting a subset of the digital image data corresponding to a horizontal row of the pixels by a plurality of first latches;

dividing the subset of the digital image data into either a red image data and a green image data or a first blue image data and a second blue image data by a plurality of second latches;

generating a red analog image signal and a green analog image signal by converting red and green image data received from the plurality of second latches using a first gamma voltage set for equally subdividing red and green grayscale levels by an RG_digital analog converter;

generating a first blue analog image signal and a second blue analog image signal by converting the first and second blue image data using a second gamma voltage set for equally subdividing blue grayscale levels by a B_digital analog converter; and amplifying the red image data, the green image data, the first blue image data and the second blue image data by a plurality of output buffers.

16. The method according to claim 13, wherein routing each of the analog image signals comprises:

supplying an image signal from a (3i−2)th output buffer of the data driving unit to a (3i−2)th output channel using a first switch in response to receiving the channel change signal (where i is an integer larger than 0);

supplying an image signal from a (3i)th output buffer of the data driving unit to a (3i−2)th output channel using a second switch in response to receiving the channel change signal;

supplying an image signal from a (3i−2)th output buffer of the data driving unit to a (3i−1)th output channel using a third switch in response to receiving the channel change signal;

supplying an image signal from a (3i−1)th output buffer of the data driving unit to a (3i−1)th output channel using a fourth switch in response to receiving the channel change signal;

supplying an image signal from a (3i)th output buffer of the data driving unit to a (3i−1)th output channel using a fifth switch in response to receiving the channel change signal;

supplying an image signal from a (3i−1)th output buffer of the data driving unit to a (3i)th output channel using a sixth switch in response to receiving the channel change signal; and supplying an image signal from a (3i)th output buffer to a (3i)th output channel using a seventh switch in response to receiving the channel change signal.

17. The method according to claim 16, wherein the pixels are repeated in an order of RGB, and wherein routing each of the analog image signals further comprises:

turning on the first, fourth and seventh switches of the data driving unit during the first times; and turning on the first, fifth and sixth switches of the data driving unit during the second times.

18. The method according to claim 16, wherein the pixels are repeated in an order of RGBG, BGRG or a combination of RGRG and BGBG, and wherein routing each of the analog image signals further comprises:

turning on the first and seventh switches of the channel switching unit during the first times; and turning on the first and sixth switches of the channel switching unit during the second times.

19. The method according to claim 13, wherein routing each of the analog image signals comprises:

connecting the first set of data lines to corresponding output channels at the first times, the first set of data lines comprising (6i−5)th data line, (6i−2)th data line, and (6i)th data line, the (6i−5)th data line connected to (3i−2)th output channel, the (6i−2)th data line connected to (3i−1)th output channel, and the (6i)th data line connected to (3i)th output channel (where i is an integer larger than 0); and connect the second set of data lines to corresponding output channels at the second times, the second set of data lines comprising (6i−4)th data line, (6i−3)th data line, and (6i−1)th data line, the (6i−4)th data line connected to (3i−2)th output channel, (6i−3)th data line connected to (3i−1)th output channel, and (6i−1)th data line connected to (3i)th output channel.

20. The method according to claim 13, wherein routing each of the analog image signals comprises:

connecting the first set of data lines to corresponding output channels at the first times, the first set of data lines comprising (4i−3)th data line and (4i−1)th data line, (4i−3)th data line connected to (3i−2)th output channel and (4i−1)th data line connected to (3i)th output channel (where i is an integer larger than 0); and connecting the second set of data lines to corresponding output channels at the second times, the second set of data lines comprising (4i−2)th data line and (4i)th data line, the (4i−2)th data line connected to (3i−2)th output channel and the (4i)th data line connected to (3i)th output channel.

21. An image display device comprising:

a first display panel including a plurality of pixel regions of a first predetermined color arrangement of pixels for displaying an image;

a plurality of data lines comprising a first set of data lines and a second set of data lines, each of the plurality of data lines connected to a corresponding pixel to carry an analog image signal for the corresponding pixel;

a first switching circuit configured to support a plurality of color arrangements of pixels of a plurality of display panels, the first switching circuit coupled to receive analog image signals and route the received analog image signals to a plurality of output channels according to a channel change signal that differs when the data driving unit supports a second display panel with a second predetermined color arrangement of pixels that is one of the plurality of color arrangements of the pixels of the plurality of display panels; and a second switching unit coupled to the first switching circuit to receive the routed analog image signals, the second switching unit configured to select the first set of data lines at first times to transmit a subset of the analog image signals to the plurality of pixels, wherein the channel change signal differs according to the second predetermined color arrangement of the pixels of the second display panel.

22. The image display device of claim 21, wherein the second switching unit is configured to select the second set of data lines to transmit another subset of the analog image signals to the plurality of pixels at second times.

23. A data driving circuit in an image display device, the data driving circuit comprising:

an input configured to receive digital image data representing color values of a plurality of pixels for a first display panel in the image display device, the first display panel including a plurality of pixel regions having a first predetermined color arrangement of pixels;

at least one digital to analog converter coupled to the input and configured to generate analog image signals corresponding to the digital image data; and a channel switching circuit coupled to the at least one digital to analog converter, the channel switching circuit configured to enable the data driving circuit to support a plurality of color arrangements of pixels of a plurality of display panels by routing each of the analog image signals to each of a plurality of output channels according to a channel change signal that differs when the data driving circuit supports a second display panel with a second predetermined color arrangement of pixels of the plurality of color arrangements of pixels, the second predetermined color arrangement being one of the plurality of color arrangements of the pixels of the plurality of display panels, wherein the channel change signal differs according to the second predetermined color arrangement of the pixels of the second display panel.

* * * * *